US007568500B2

(12) United States Patent
Huang

(10) Patent No.: US 7,568,500 B2
(45) Date of Patent: Aug. 4, 2009

(54) CO-AXIAL PRESSURE RELIEF DEVICE FOR AIR INFLATOR

(76) Inventor: Daniel Huang, 58, Ma Yuan West St., Taichung (TW)

( * ) Notice: Subject to any disclaimer, the term of this patent is extended or adjusted under 35 U.S.C. 154(b) by 529 days.

(21) Appl. No.: 11/506,483

(22) Filed: Aug. 21, 2006

(65) Prior Publication Data

US 2008/0041457 A1 Feb. 21, 2008

(51) Int. Cl.
*F15B 13/04* (2006.01)

(52) U.S. Cl. ..... 137/596; 137/228; 417/374; 417/559; 600/498

(58) Field of Classification Search ..... 137/226, 137/228, 589, 596; 417/559, 374, 569, 571; 600/490, 498
See application file for complete search history.

(56) References Cited

U.S. PATENT DOCUMENTS

| | | | | | |
|---|---|---|---|---|---|
| 1,918,544 | A | * | 7/1933 | House et al. | 137/596 |
| 2,006,878 | A | * | 7/1935 | Bandoly | 600/498 |
| 2,189,361 | A | * | 2/1940 | Hoge | 137/596 |
| 3,030,945 | A | * | 4/1962 | Clark | 600/498 |
| 3,254,671 | A | * | 6/1966 | Berliner | 600/498 |
| 3,504,663 | A | * | 4/1970 | Edwards | 600/498 |
| 3,875,961 | A | * | 4/1975 | Gibbens | 137/223 |
| 3,893,478 | A | * | 7/1975 | Peters | 600/498 |
| 3,906,939 | A | * | 9/1975 | Aronson | 600/493 |
| 4,037,587 | A | * | 7/1977 | Kaneda et al. | 600/498 |
| 4,050,311 | A | * | 9/1977 | Leach | 600/498 |
| 4,098,291 | A | * | 7/1978 | Clark et al. | 600/498 |
| 4,139,000 | A | * | 2/1979 | Peeler | 600/490 |
| 4,146,018 | A | * | 3/1979 | Aldridge et al. | 600/498 |
| 4,200,259 | A | * | 4/1980 | Ueda | 600/498 |
| 4,416,287 | A | * | 11/1983 | Riester | 600/498 |
| 4,690,171 | A | * | 9/1987 | Johnston | 600/498 |
| 4,948,092 | A | * | 8/1990 | Kasper et al. | 137/226 |
| 5,556,258 | A | * | 9/1996 | Lange et al. | 417/63 |
| 2007/0185403 | A1 | * | 8/2007 | Yang et al. | 600/498 |

* cited by examiner

*Primary Examiner*—John Rivell
*Assistant Examiner*—Craig Price
(74) *Attorney, Agent, or Firm*—Alan Kamrath; Kamrath & Associates PA

(57) ABSTRACT

A pressure relief device for an air inflator includes a pipe connector, a seal member, a check valve mounting ring, a check valve, an air cell connector, and a pressure relief control ring. Thus, the pressure relief control ring is tightened to perform the air inflating action and loosened to perform the pressure relief action, so that the air inflating action and the pressure relief action are performed along the same axis, and the pressure relief device has a co-axial operation function, thereby facilitating the user inflating and deflating the inflatable body. In addition, the air inlet hole is not mounted in the air cell to facilitate the user compressing the air cell.

4 Claims, 8 Drawing Sheets

CO-AXIAL PRESSURE RELIEF DEVICE FOR AIR INFLATOR

BACKGROUND OF THE INVENTION

1. Field of the Invention

The present invention relates to a pressure relief device and, more particularly, to a co-axial pressure relief device for an air inflator.

2. Description of the Related Art

A conventional pressure relief device for an air inflator in accordance with the prior art shown in FIGS. 6 and 7 is disclosed in the U.S. Pat. No. 4,998,562 and comprises a guide pipe 13 having a first end connected to an air cell 14 and a second end connected to an inflatable body (not shown), a pressure relief tube 12 mounted on and perpendicular with the guide pipe 13, and a rotation screw 11 rotatably mounted on the pressure relief tube 12. The air cell 14 has an air inlet hole 17. Thus, when the rotation screw 11 is tightened, the air contained in the air cell 14 is compressed to pass through the pressure relief tube 12 into the inflatable body to inflate the inflatable body, and when the rotation screw 11 is loosened, the air contained in the inflatable body is released outwardly through a gap between the rotation screw 11 and the pressure relief tube 12 to release the pressure in the inflatable body.

However, the conventional pressure relief device has a double-axis type pressure relief structure, so that the conventional pressure relief device has a complicated construction, thereby increasing the costs of fabrication. In addition, the air inlet hole 17 is located at a rear portion of the air cell 14, so that when the air cell 14 is compressed by a user, the air inlet hole 17 is held by the user's one hand, thereby easily causing an uncomfortable sensation to the user during operation of the air cell 14. Further, the rotation screw 11 and the pressure relief tube 12 are protruded outwardly from the guide pipe 13 in a perpendicular manner, so that the rotation screw 11 and the pressure relief tube 12 are easily deformed or broken due to hit of an external force. Further, the rotation screw 11 and the pressure relief tube 12 are protruded outwardly from the guide pipe 13, so that the pressure relief device has a larger volume, thereby causing inconvenience in packaging, storage and transportation of the pressure relief device.

Another conventional pressure relief device for an air inflator in accordance with the prior art shown in FIG. 8 comprises a guide pipe 16 having a first end connected to an air cell 14 and a second end connected to an inflatable body (not shown), a pressure relief bar 18 mounted on and perpendicular with the guide pipe 16, and a push button 15 movably mounted on the pressure relief bar 18. The air cell 14 has an air inlet hole 17. Thus, when the push button 15 is pressed, the air contained in the inflatable body is released outwardly through a gap between the guide pipe 16 and the pressure relief bar 18 to release the pressure in the inflatable body.

However, the conventional pressure relief device has a double-axis type pressure relief structure, so that the conventional pressure relief device has a complicated construction, thereby increasing the costs of fabrication. In addition, the air inlet hole 17 is located at a rear portion of the air cell 14, so that when the air cell 14 is compressed by a user, the air inlet hole 17 is held by the user's one hand, thereby easily causing an uncomfortable sensation to the user during operation of the air cell 14. Further, the push button 15 and the pressure relief bar 18 are protruded outwardly from the guide pipe 16 in a perpendicular manner, so that the push button 15 and the pressure relief bar 18 are easily deformed or broken due to hit of an external force. Further, the push button 15 and the pressure relief bar 18 are protruded outwardly from the guide pipe 16, so that the pressure relief device has a larger volume, thereby causing inconvenience in packaging, storage and transportation of the pressure relief device.

BRIEF SUMMARY OF THE INVENTION

In accordance with the present invention, there is provided a pressure relief device, comprising a pipe connector, a seal member mounted on the pipe connector, a check valve mounting ring mounted on the pipe connector and rested on the seal member, a check valve mounted in the check valve mounting ring, an air cell connector having a first end mounted on the check valve mounting ring and formed with at least one air inlet hole for mounting a movable stop ball, and a pressure relief control ring rotatably mounted on the second end of the pipe connector and screwed onto the first end of the air cell connector.

Thus, when the pressure relief control ring is screwed onto the air cell connector, the check valve mounting ring is rested on the seal member closely to form a sealed state between the check valve mounting ring and the pipe connector to allow air into an inflatable body so as to inflate the inflatable body, and when the pressure relief control ring is unscrewed from the air cell connector, the check valve mounting ring is detached from the seal member to separate the check valve mounting ring from the pipe connector, so that the air contained in the inflatable body flows through the pipe connector and is drained outwardly from a gap between the check valve mounting ring and the pipe connector so as to release a pressure in the inflatable body.

The primary objective of the present invention is to provide a co-axial pressure relief device for an air inflator.

Another objective of the present invention is to provide a pressure relief device, wherein the pressure relief control ring is tightened to perform the air inflating action and loosened to perform the pressure relief action, so that the air inflating action and the pressure relief action are performed along the same axis, and the pressure relief device has a co-axial operation function, thereby facilitating the user inflating and deflating (or releasing) the inflatable body.

A further objective of the present invention is to provide a pressure relief device, wherein when the pressure relief control ring is screwed onto the air cell connector, the check valve mounting ring and the pipe connector are sealed closely by the seal member to prevent the air from leaking outwardly during the inflating process.

A further objective of the present invention is to provide a pressure relief device, wherein the air inlet hole is mounted in the air cell connector, so that the air cell is not provided with the air inlet hole to facilitate the user compressing the air cell.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
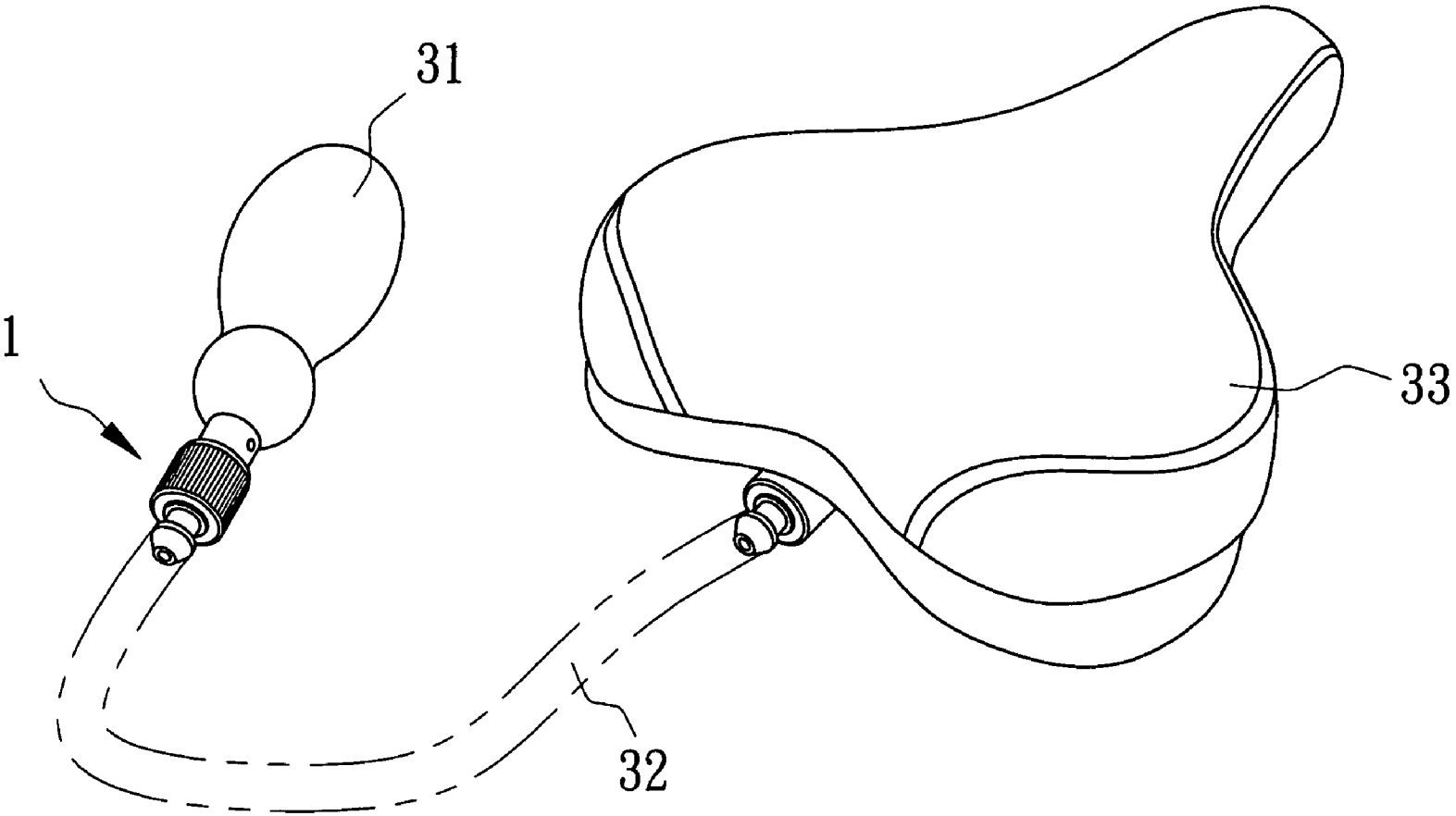
FIG. 1 is a perspective view of an air inflator in accordance with the preferred embodiment of the present invention.
Figure 2:
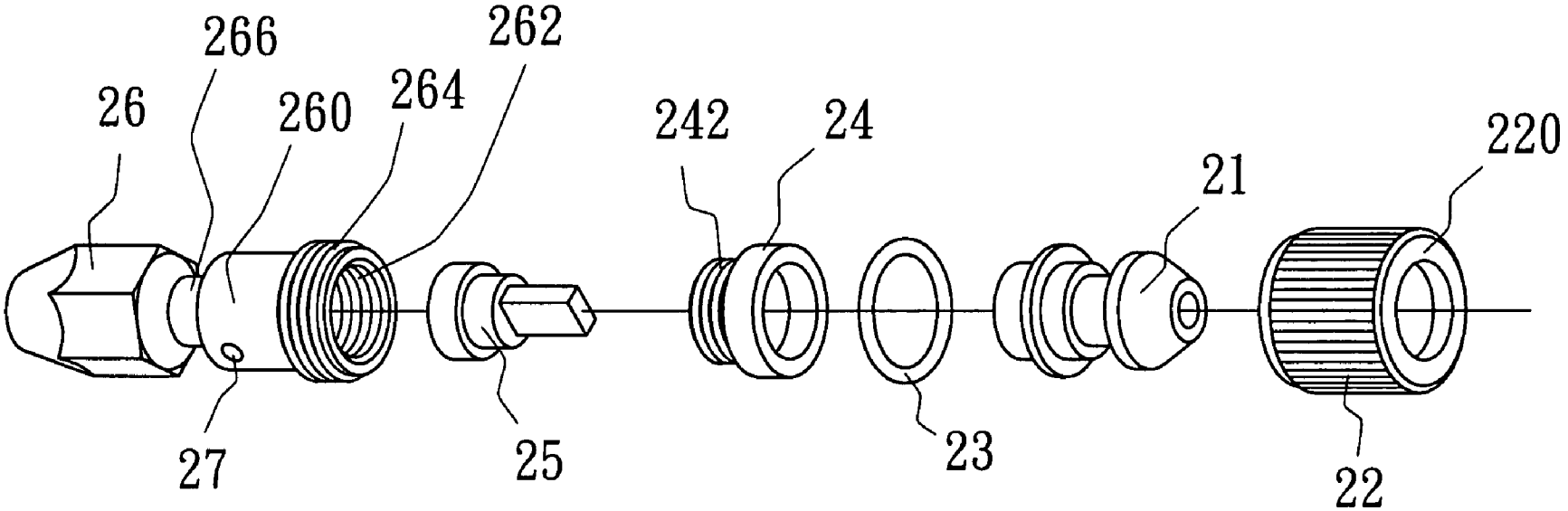
FIG. 2 is an exploded perspective view of a pressure relief device for the air inflator in accordance with the preferred embodiment of the present invention.
Figure 3:
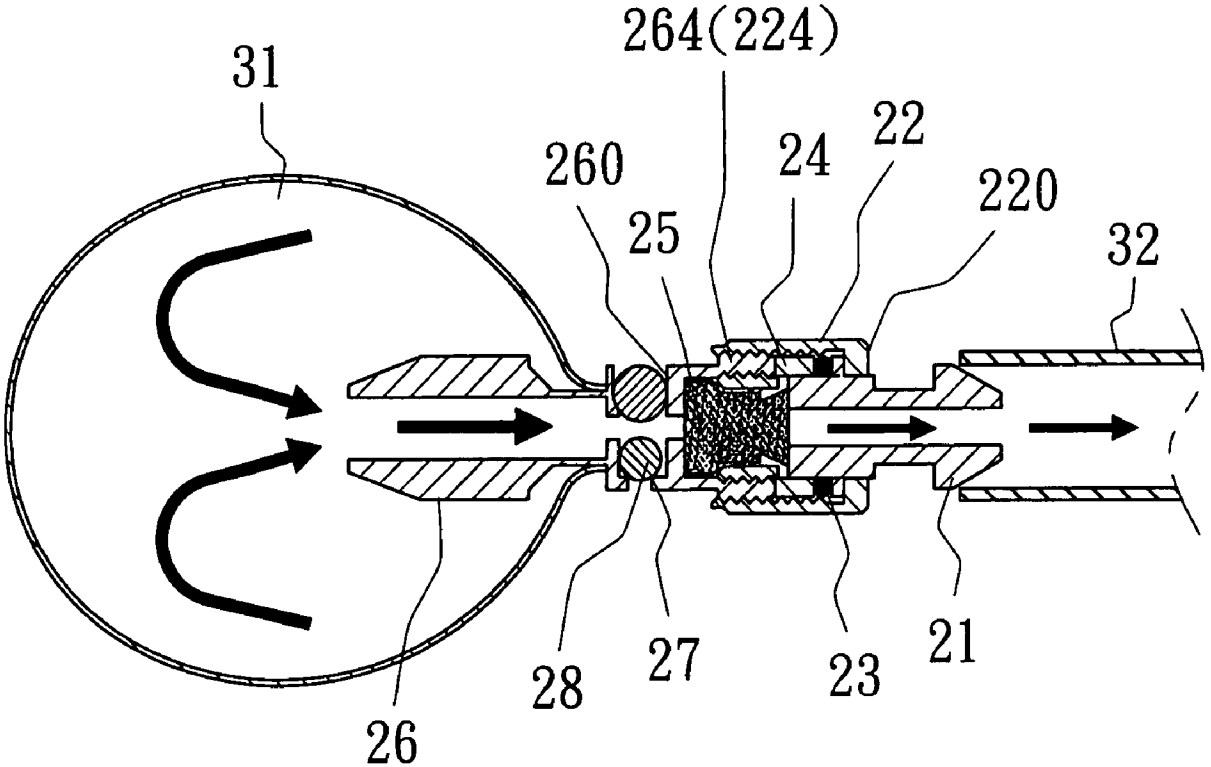
FIG. 3 is a partially plan cross-sectional view of the air inflator as shown in FIG. 1.

Referring to the drawings and initially to FIGS. 1-3, an air inflator in accordance with the preferred embodiment of the present invention comprises a pressure relief device 1, an air cell 31 connected to a first side of the pressure relief device 1, a guide pipe 32 having a first end connected to a second side of the pressure relief device 1, and an inflatable body 33 connected to a second end of the guide pipe 32.

The pressure relief device 1 includes a pipe connector 21 having a first end inserted into and connected to the guide pipe 32, a seal member 23 mounted on a second end of the pipe connector 21, a check valve mounting ring 24 mounted on the second end of the pipe connector 21 and rested on the seal member 23, a check valve 25 mounted in the check valve mounting ring 24, an air cell connector 26 having a first end mounted on the check valve mounting ring 24 and formed with at least one air inlet hole 27 for mounting a movable stop ball 28 and a second end inserted into the air cell 31, and a pressure relief control ring 22 rotatably mounted on the second end of the pipe connector 21 and screwed onto the first end of the air cell connector 26.

The pressure relief control ring 22 has an open end portion formed with an inwardly extending annular limit flange 220 to limit the second end of the pipe connector 21. The seal member 23 is made of an elastomeric material. The first end of the air cell connector 26 has an inner wall formed with an inner thread 262 and an outer wall formed with an outer thread 264. The air cell connector 26 has a mediate portion formed with an annular neck portion 266 having a reduced diameter for mounting the air cell 31. The air cell connector 26 is connected to the check valve 25, and the check valve 25 is connected to the pipe connector 21. The check valve mounting ring 24 has an outer wall formed with an outer thread 242 screwed into the inner thread 262 of the air cell connector 26. The pressure relief control ring 22 has an inner wall formed with an inner thread 224 (see FIG. 3) screwed onto the outer thread 264 of the air cell connector 26.

As shown in FIGS. 1-3, when the pressure relief control ring 22 is tightly screwed onto the air cell connector 26 as shown in FIG. 3, the check valve mounting ring 24 is rested on the seal member 23 closely to form a sealed state between the check valve mounting ring 24 and the pipe connector 21. Thus, when the air cell 31 is compressed, the air contained in the air cell 31 is drained outwardly from the air cell 31 to flow through the air cell connector 26, the check valve 25, the pipe connector 21 and the guide pipe 32 into the inflatable body 33 as shown in FIG. 1 so as to inflate the inflatable body 33. At this time, the stop ball 28 is pressed by the air flowing through the air cell connector 26, so that the stop ball 28 is rested on the air inlet hole 27 of the air cell connector 26 to prevent the air from leaking outwardly from the air inlet hole 27 of the air cell connector 26.

Figure 4:
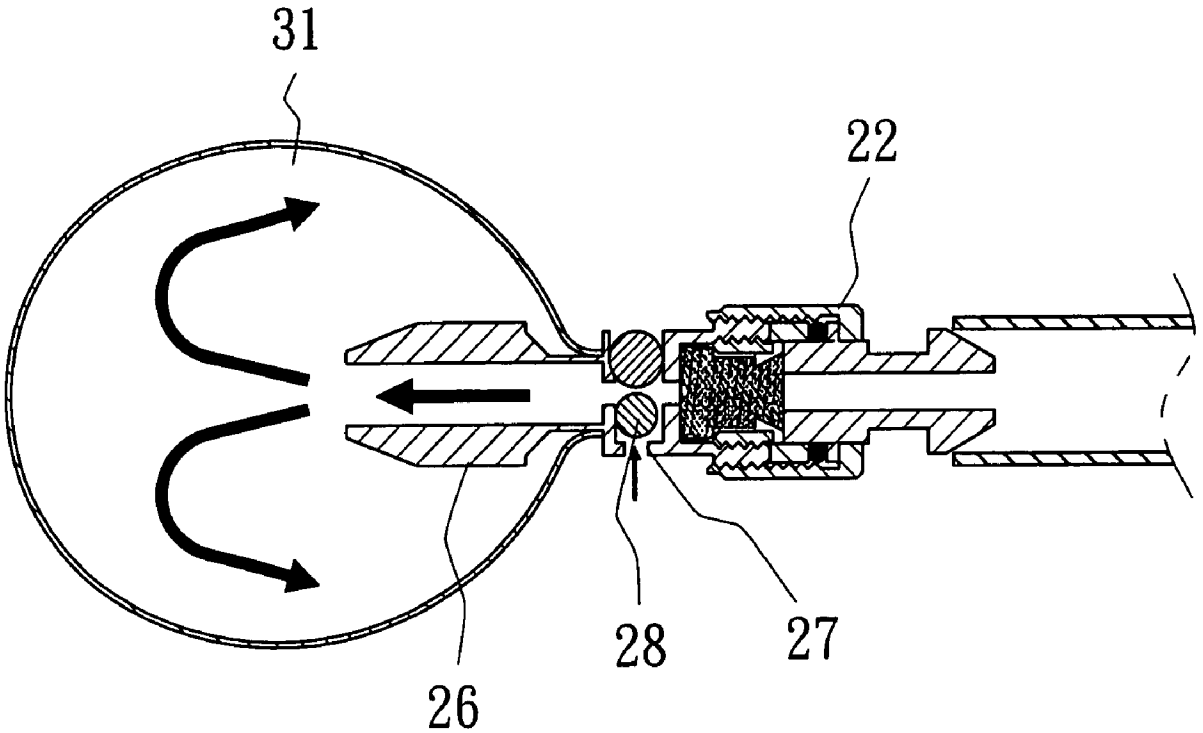
FIG. 4 is a schematic operational view of the pressure relief device for an air inflator as shown in FIG. 3.

As shown in FIG. 4, when the air contained in the air cell 31 is exhausted, the stop ball 28 is pressed by the ambient air and sucked by the suction force produced in the inside of the air cell 31, so that the stop ball 28 is detached from the air inlet hole 27 of the air cell connector 26 to allow the ambient air flowing through the air inlet hole 27 of the air cell connector 26 into the air cell 31 so as to fill the air into the air cell 31.

Figure 5:
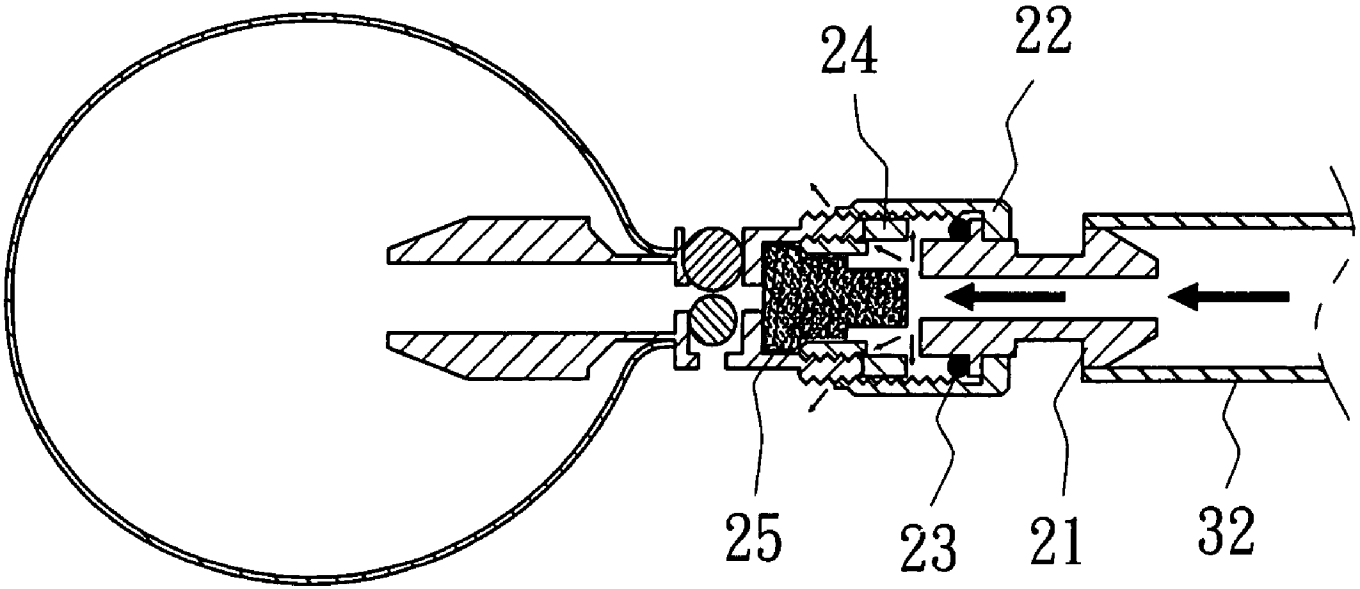
FIG. 5 is a schematic operational view of the pressure relief device for an air inflator as shown in FIG. 3.
Figure 6:
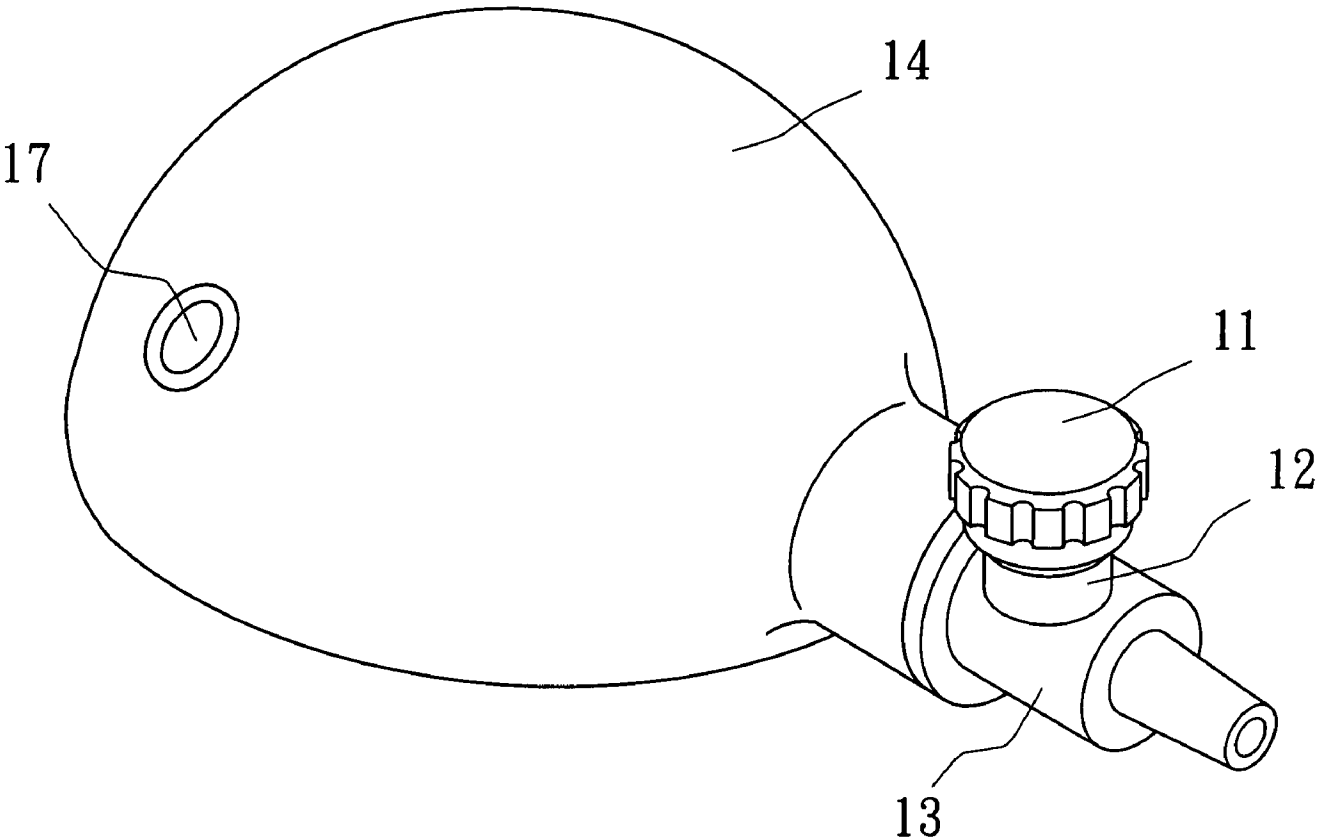
FIG. 6 PRIOR ART
FIG. 6 is a perspective view of a conventional air inflator in accordance with the prior art.
Figure 7:
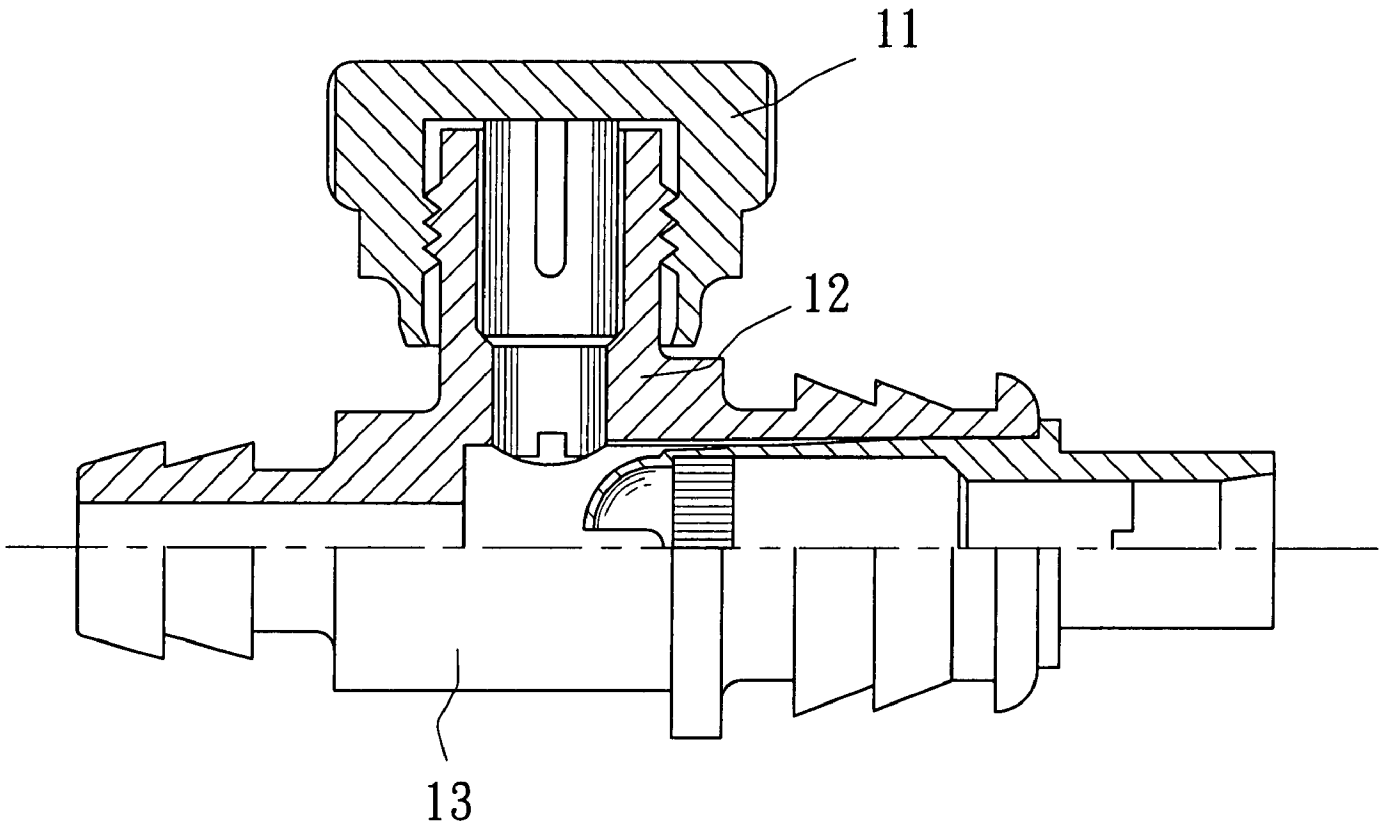
FIG. 7 PRIOR ART
FIG. 7 is a partially plan cross-sectional view of the conventional air inflator as shown in FIG. 6.
Figure 8:
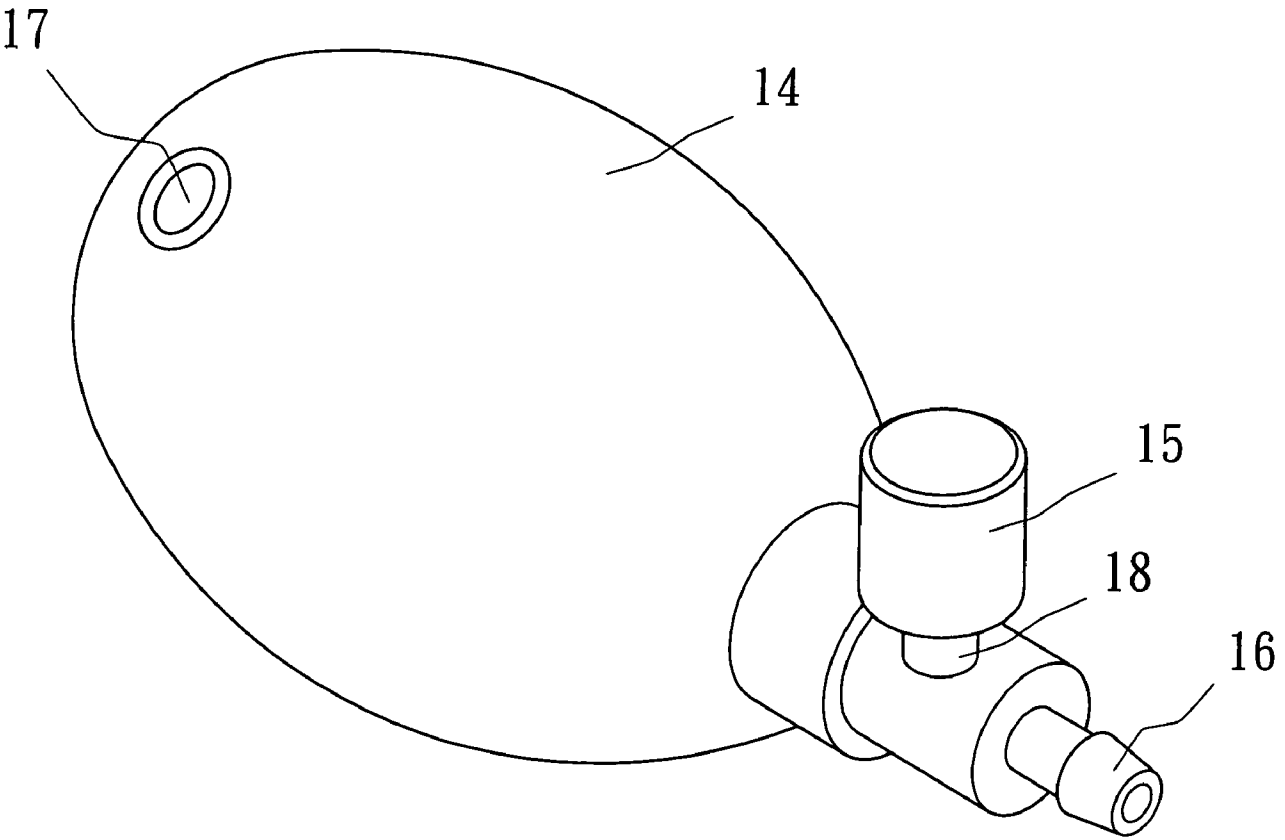
FIG. 8 PRIOR ART
FIG. 8 is a perspective view of another conventional air inflator in accordance with the prior art.

As shown in FIGS. 1 and 5, when the pressure relief control ring 22 is unscrewed from the air cell connector 26 as shown in FIG. 5, the check valve mounting ring 24 is detached from the seal member 23 to separate the check valve mounting ring 24 from the pipe connector 21, so that the air contained in the inflatable body 33 flows through the pipe connector 21 and is drained outwardly from a gap between the check valve mounting ring 24 and the pipe connector 21 as shown in FIG. 5 so as to release the pressure in the inflatable body 33.

Accordingly, the pressure relief control ring 22 is tightened to perform the air inflating action and loosened to perform the pressure relief action, so that the air inflating action and the pressure relief action are performed along the same axis, and the pressure relief device has a co-axial operation function, thereby facilitating the user inflating and deflating (or releasing) the inflatable body 33. In addition, when the pressure relief control ring 22 is screwed onto the air cell connector 26, the check valve mounting ring 24 and the pipe connector 21 are sealed closely by the seal member 23 to prevent the air from leaking outwardly during the inflating process. Further, the air inlet hole 27 is mounted in the air cell connector 26, so that the air cell 31 is not provided with the air inlet hole 27 to facilitate the user compressing the air cell 31.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A co-axial pressure relief device for an air inflator, the co-axial pressure relief device at least comprising a pressure relief control ring, a pipe connector, a seal member, a check valve mounting ring, a check valve, an air inlet hole, a stop ball and an air cell connector, wherein the pressure relief control ring is jammed with the pipe connector, a rear end of the pipe connector passes through the seal member, and the check valve is mounted into the check valve mounting ring and screwed to the air cell connector, a front section of the air cell connector is formed with the air inlet hole, in which the stop ball is disposed, the pressure relief device is formed by threads of an inner side of the pressure relief control ring and the front section of the air cell connector, which are rotated relative to and fit with each other, and wherein:

controlling and rotating in the pressure relief control ring enables the check valve mounting ring and the pipe connector to combine together tightly to inflate the air inflator, and controlling and rotating out the pressure relief control ring enables gas in the air inflator to be deflated out of a gap between the check valve mounting ring and the pipe connector, such that a co-axial inflating and pressure relief mechanism is formed.

2. The pressure relief device in accordance with claim 1, wherein the pipe connector is connected to a guide pipe which is connected to the inflatable body.

3. The pressure relief device in accordance with claim 1, wherein the air cell connector has a second end connected to an air cell.

4. The pressure relief device in accordance with claim 1, wherein the air cell connector is co-axial with the pressure relief control ring, and the air inlet hole is located at a determined position of the air cell connector.

* * * * *